US009051824B2

(12) United States Patent
Broussard et al.

(10) Patent No.: US 9,051,824 B2
(45) Date of Patent: Jun. 9, 2015

(54) MULTIPLE ANNULUS UNIVERSAL MONITORING AND PRESSURE RELIEF ASSEMBLY FOR SUBSEA WELL COMPLETION SYSTEMS AND METHOD OF USING SAME

(75) Inventors: Earl Broussard, Houston, TX (US); Richard Jolly, Cypress, TX (US)

(73) Assignee: Proserv Operations Inc., Houston, TX (US)

( * ) Notice: Subject to any disclaimer, the term of this patent is extended or adjusted under 35 U.S.C. 154(b) by 488 days.

(21) Appl. No.: 13/448,118

(22) Filed: Apr. 16, 2012

(65) Prior Publication Data

US 2013/0062056 A1 Mar. 14, 2013

Related U.S. Application Data

(60) Provisional application No. 61/475,542, filed on Apr. 14, 2011.

(51) Int. Cl.

| | |
|---|---|
| ***E21B 33/043*** | (2006.01) |
| ***E21B 47/10*** | (2012.01) |
| ***E21B 47/00*** | (2012.01) |
| ***E21B 33/04*** | (2006.01) |

(52) U.S. Cl.

CPC ..... *E21B 47/1025* (2013.01); *E21B 33/043* (2013.01); *E21B 47/0001* (2013.01); *E21B 33/04* (2013.01)

(58) Field of Classification Search

CPC ... E21B 33/04; E21B 33/043; E21B 47/1025; E21B 47/0001

USPC ..... 166/368, 348, 250.01, 250.15, 382, 166/75.14

See application file for complete search history.

(56) References Cited

U.S. PATENT DOCUMENTS

| | | | | |
|---|---|---|---|---|
| 2,502,886 | A | 4/1950 | Ragan | |
| 4,848,457 | A * | 7/1989 | Lilley | 166/321 |
| 5,366,017 | A * | 11/1994 | Voss, Jr. | 166/368 |
| 6,360,822 | B1 * | 3/2002 | Robertson | 166/368 |
| 6,705,401 | B2 * | 3/2004 | Buckle et al. | 166/337 |
| 7,073,591 | B2 * | 7/2006 | Massie et al. | 166/348 |

(Continued)

OTHER PUBLICATIONS

"Rupture Disc." from Wikipedia, cited at http://en,wikipedia.org/wiki/Repture_disc. Sep. 9, 2011.

(Continued)

*Primary Examiner* — Matthew Buck

(74) *Attorney, Agent, or Firm* — Douglas W. Rommelmann; Andrew Kurth LLP

(57) ABSTRACT

A well completion system for monitoring multiple annuluses in a well, including an "A" annulus (between the production tubing and production casing) and a "B" annulus (between the production casing and intermediate casing). The system includes a tubing hanger suspension assembly that seals and separates an upper area of the production annulus. Port(s) in the production casing above the seal provide access between the "B" annulus and the separated area. The system also includes a moveable sleeve that allows fluid communication through the port(s) when in an open position, but not in a closed position. The tubing hanger suspension assembly includes means for moving the sleeve from the closed position to the open position. In addition, the tubing hanger housing includes "A" and "B" annulus passageways in communication with the production annulus and the separated area, respectively.

28 Claims, 10 Drawing Sheets

(56) References Cited

U.S. PATENT DOCUMENTS

| | | | | |
|---|---|---|---|---|
| 7,090,027 | B1 * | 8/2006 | Williams | 166/386 |
| 7,191,830 | B2 * | 3/2007 | McVay et al. | 166/242.1 |
| 7,419,001 | B2 | 9/2008 | Broussard | |
| 8,316,946 | B2 * | 11/2012 | June et al. | 166/344 |
| 2003/0006041 | A1 | 1/2003 | Baten | |
| 2003/0121667 | A1 * | 7/2003 | Massie et al. | 166/344 |
| 2006/0260799 | A1 | 11/2006 | Broussard | |
| 2009/0211761 | A1 | 8/2009 | Broussard | |
| 2010/0101800 | A1 * | 4/2010 | June et al. | 166/344 |
| 2010/0116488 | A1 * | 5/2010 | Baskett et al. | 166/153 |
| 2011/0147001 | A1 * | 6/2011 | Thomson | 166/348 |

OTHER PUBLICATIONS

International Search Report and written opinion of corresponding application No. PCT/US2012/033816 dated Jul. 6, 2012.

* cited by examiner

MULTIPLE ANNULUS UNIVERSAL MONITORING AND PRESSURE RELIEF ASSEMBLY FOR SUBSEA WELL COMPLETION SYSTEMS AND METHOD OF USING SAME

CROSS-REFERENCE TO RELATED APPLICATIONS

This application claims the benefit of U.S. Provisional Patent Application Ser. No. 61/475,542, filed Apr. 14, 2011.

BACKGROUND OF THE INVENTION

1. Field of the Invention

The present invention relates to a subsea wellhead assembly for an oil and/or gas well, and more particularly to a tubing hanger assembly and annulus sleeve that allows simultaneous control over both the production casing annulus and casing annulus outside the production casing.

2. Description of Related Art

A typical subsea wellhead assembly includes a wellhead housing installed at the sea floor. Generally, as a well bore is drilled, successive concentric casing strings are installed in the well bore. The area between adjacent casings strings is known as an annulus.

Typically, each successive casing string is cemented at its lower end, and includes a casing hanger sealed with a mechanical seal assembly at its upper end in the wellhead housing. Accordingly, the upper end of each casing string is sealed, and any fluid located in the annulus between adjacent casing strings is thereby trapped. Typically, cement is not brought to the casing shoe at the lower end of each casing string. This allows thermal expansion of the fluid trapped in the annulus of the casings into the formation through the lower end of each casing. The amount of thermal expansion of this trapped fluid, as well as other properties of the fluid (e.g., pressure, etc.), are generally unknown during the drilling and production phases of the well.

A greater knowledge of the properties of the fluid trapped in the annuluses of the casing strings would be of great benefit during long term production of the well. Specifically, the area within the innermost casing string, known as the production casing, and outside of the production tubing is the "A" annulus. The area immediately outside the production casing, but within the first intermediate casing, is the "B" annulus. For example, at times, when it is anticipated that the well will be produced, cement is placed in the lower part of the first intermediate casing string to seal annulus "B". This sealing of annulus "B" helps to protect the formation from leakage in the event that fluid gets into annulus "B" from the production reservoir. One downside to sealing annulus "B", however, is that high pressure areas may develop once it is sealed. While it is known to use burst or rupture disks to relieve pressure and reduce the possibility that the production casing will collapse, this can result in leakage into the environment. It would be preferable to be able to monitor and control the pressure inside annulus "B". In addition, the casings that are installed deep in the well may be less pressure-resistant, thereby increasing the possibility of collapse if the pressures in the annuluses become too great. The ability to monitor and control the pressures in both annulus "A" and annulus "B" could prevent such leakage of the fluid or collapse of the production tubing and/or production casing.

When a well has been drilled and cased, certain steps are taken to prepare the well for production. For example, a production tubing string and a tubing hanger are run into the well bore through the BOP stack. Typically, the tubing hanger is landed, sealed, and locked in the wellhead housing and/or the production casing hanger. Thereafter, the production bore extending through the tubing hanger is sealed, the BOP stack is removed, and a christmas tree is lowered onto the wellhead housing. A christmas tree is an assembly of valves, spools, pressure gauges and chokes fitted to the wellhead of a completed well to control production. It is important to the operation and safety of the well that that the proper connections are made between the christmas tree, the wellhead housing, and the tubing hanger. While most current christmas tree designs provide for measuring and controlling pressure in annulus "A", none are capable of measuring and/or controlling pressure in annulus "B".

Accordingly, it would be desirable to have a subsea well completion system that allows for monitoring and control of pressure in both the "A" annulus and the "B" annulus. In fact, a device that provides the ability to monitor and control pressure in the "B" annulus is something that has been asked for by regulatory bodies. However, it has heretofore been given regulatory exemption because it does not exist.

BRIEF SUMMARY OF THE INVENTION

An embodiment of the present invention provides an oil or gas well completion system having a production casing adapter sleeve, a tubing hanger suspension assembly with "B" annulus porting, a christmas tree with "B" annulus control assembly, and a method of installing same. This system shares many features with U.S. Pat. No. 7,419,001, which reference is hereby incorporated herein by reference. In addition, the system of the present invention may also include a sleeve with a seal system assembly that opens and closes a port between annulus "A" and "B". This sleeve may preferably be installed in the production casing string prior to running the production casing. The tubing hanger may carry an articulating latch ring that expands into a groove in the production casing adapter sleeve. In one embodiment, the weight of the production tubing string and tubing hanger suspension assembly opens the ports to the "B" annulus. In addition, the tubing hanger suspension assembly may include a lockdown assembly that locks the seal assembly sleeve open for the "B" annulus, and may also carry a seal that seals below the ported seal assembly sleeve, thereby isolating the "B" annulus from the "A" annulus. An additional seal above the seal assembly sleeve may further serve to separate the "A" annulus from the "B" annulus.

Preferably, with the removal of the christmas tree and installation of the BOP stack, and the removal of the tubing hanger, the seal assembly sleeve is returnable to the closed and sealed position by springs, thus returning the production casing string to its original pressure containing condition from both the production casing bore and the "B" annulus side. This is required during workovers to ensure safety upon re-entering the well bore. In this way, the well can be safely reworked for reinstallation of the tubing hanger, or plugged for well abandonment. Additionally, with a valve in the "B" annulus bore of the upper body of the tubing hanger, the BOP stack can be removed safely and the christmas tree installed safely.

In one embodiment, the present invention provides a well completion system for controlling and monitoring multiple annuluses in a well, the well having production tubing string, a production casing string surrounding the production tubing string and defining an "A" annulus therebetween, and an intermediate casing string surrounding the production casing string and defining a "B" annulus therebetween. The well completion system includes a tubing hanger suspension assembly including the production tubing string and a tubing hanger having a tubing hanger lower assembly. The tubing hanger lower assembly extends around an upper length of the production tubing string and defines a production annulus between the tubing hanger lower assembly and the production tubing. The tubing hanger lower assembly arranged and designed for insertion within the production casing string. In addition, the tubing hanger lower assembly includes a seal arranged and designed to provide sealed engagement between the tubing hanger lower assembly and the production casing string, the sealed engagement providing a separated area above the seal outside the lower assembly and inside the production casing string that is segregated from the production annulus.

The well completion system also includes a "B" annulus access assembly including at least one port in the production casing string at a location above the seal, and providing access between the "B" annulus and the separated area, the "B" annulus access assembly including a moveable sleeve having an open position and a closed position, the moveable sleeve allowing fluid communication through the at least one port when in the open position, and preventing fluid communication through the at least one port when in the closed position. The tubing hanger suspension assembly includes means for moving the sleeve from the closed position to the open position, thereby allowing the "B" annulus to communicate with the separated area via the at least one port. Furthermore, the tubing hanger housing includes "A" and "B" annulus passageways, the "A" annulus passageway in communication with the production annulus, and the "B" annulus passageway in communication with the separated area.

In another embodiment, the present invention provides a method of monitoring and controlling fluid in multiple annuluses of a well, the annuluses including an "A" annulus between the production tubing and the production casing string of the well, and a "B" annulus between an intermediate casing string and the production casing string of the well. The method includes the step of providing a tubing hanger suspension assembly within the "A" annulus, the tubing hanger suspension assembly configured to seal the "A" annulus so that fluid in the "A" annulus is restricted from entering a separated portion inside the production casing string, and is channeled to a production annulus between the tubing hanger suspension assembly and the production tubing. The method further includes the step of opening ports in the production casing above the seal of the tubing hanger suspension assembly, thereby allowing fluid from the "B" annulus to pass through the production casing into the separated portion inside the production casing string. In addition, the method includes communicating with the separated portion and the production annulus to monitor and control the fluid within the annuluses.

In another embodiment, the present invention provides a method of monitoring and controlling fluid in multiple annuluses of a well, the annuluses including an A annulus between the production tubing and the production casing string of the well, and a B annulus between an intermediate casing string and the production casing string of the well.

The method includes the step of providing a tubing hanger suspension assembly within the A annulus, the tubing hanger suspension assembly configured to seal the A annulus so that fluid in the A annulus is restricted from entering a sealed upper portion of the A annulus and is channeled to a production annulus between the tubing hanger suspension assembly and the production tubing. The method also includes opening ports in the production casing above the seal of the tubing hanger suspension assembly, thereby allowing fluid from the B annulus to pass through the production casing into the sealed upper portion of the A annulus. In addition, the method includes providing a christmas tree in communication with the top of the A annulus and the production annulus to monitor and control the fluid within the annuluses.

BRIEF DESCRIPTION OF THE SEVERAL VIEWS OF THE DRAWINGS

The objects, advantages, and features of the invention will become more apparent by reference to the drawings, wherein like reference numerals indicate like parts and wherein:

In the drawings FIGS. 3, 4, and 8 are broken into multiple parts, identified individually as FIGS. 3A, 3B, 4A-4E, 8A, and 8B. This was done in order to increase the size of the drawings beyond what would normally fit on a single drawing sheet. The effect of this is that the details of the drawings are more clear. For ease of discussion, throughout the detailed description of preferred embodiments of the invention, FIGS. 3, 4, and 8 are referred to in general, without specifically referring to FIG. 3A, 3B, 4A-4E, 8A, or 8B.

DETAILED DESCRIPTION OF PREFERRED EMBODIMENTS OF THE INVENTION

Embodiments of the invention are described in detail with specific reference to the drawings. This invention concerns completion of a well that has been drilled and which has its bore hole lined with casing.

Figure 1:
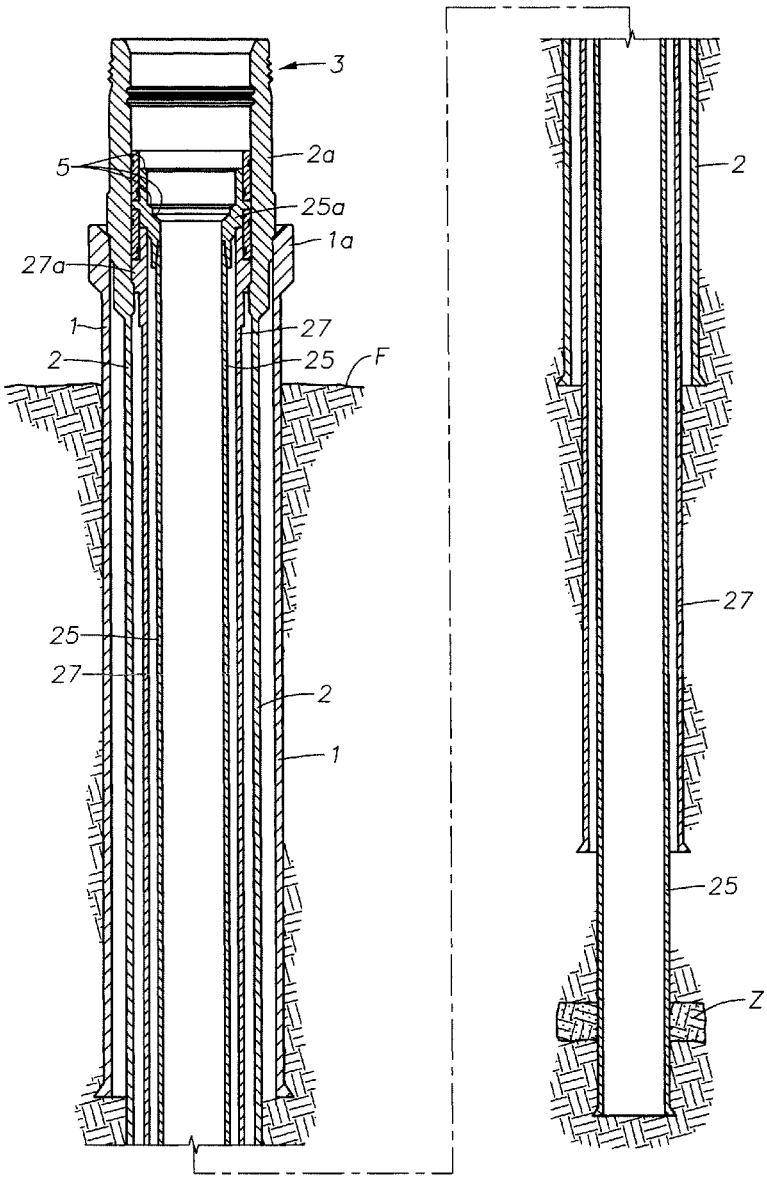
FIG. 1 is a schematic sectional elevation view showing a standard cased well bore, wellhead housing, and casing strings.

FIG. 1 illustrates a typical standard wellhead with casing lining the bore hole. Referring to FIG. 1, a typical drilled well bore is shown extending from the sea floor F down to a zone Z, typically communicating with a reservoir of hydrocarbon fluids. The well bore is shown having a series of tubular strings of casing pipe extending from the sea floor F down into the bore hole as is well known in the art. Typically, the series of pipe strings, beginning from the outermost string, includes a conductor casing 1 with an upper housing 1*a*, a surface casing 2 with an upper wellhead housing 2*a*, a first or intermediate casing string 27 with an intermediate casing hanger 27*a*, and an inner or production casing string 25 with a production casing hanger 25*a*.

Still referring to FIG. 1, the top of the conductor housing 1*a* is preferably above the sea floor F. The wellhead housing 2*a*, preferably a high pressure housing, extends above the conductor housing 1*a*. Preferably, the top of the wellhead housing 2*a* is about ten feet above the sea floor F. The wellhead housing 2*a* typically includes an external profile 3 for connection with a connector of a blowout preventer ("BOP") stack and an oilfield christmas tree connector 29 (FIG. 3) as will be described below. Typically, the casing hangers 25*a* and 27*a* are landed and secured in the wellhead housing 2*a*.

Although not shown, the wellhead housing 2*a* typically includes several internal profiles, dimensions, and details for landing, locking and sealing the stacked casing hangers 25*a* and 27*a* in the wellhead housing 2*a*. Each wellhead manufacturer has several wellhead housings with corresponding casing hangers for each wellhead housing. As a result, the casing hangers 25*a* and 27*a* installed in the wellhead housing 2*a* are typically manufactured by the same company since each manufacturer's wellhead housings and casing hangers are different from any other manufacturer.

Following the setting of the casings shown in FIG. 1, a tubing hanger assembly is typically run in the conventional well. Although not shown, a typical prior art tubing hanger assembly for a conventional well (i.e., a well in which the tubing hanger in landed in the wellhead housing 2*a*) includes a housing having a string of production tubing extending from the housing substantially down to the production zone Z. A typical prior art tubing hanger installed in the wellhead housing 2*a* of FIG. 1 lands on one or more shoulders 5 in the production casing hanger 25*a* and the weight of the suspended production tubing string is supported by the production casing hanger 25*a*. Although not shown, casing hanger 25*a* includes internal profiles, dimensions, and details for landing, locking, and sealing a typical prior art tubing hanger in the production casing hanger 25*a*. Similar to the above, each casing hanger manufacturer has its own proprietary configuration with respect to mating and connecting with the tubing hanger. As a result, in the typical conventional well, the tubing hanger is usually manufactured by the same manufacturer of the casing hanger(s) which is also typically the same as the wellhead housing manufacturer.

Figure 2:
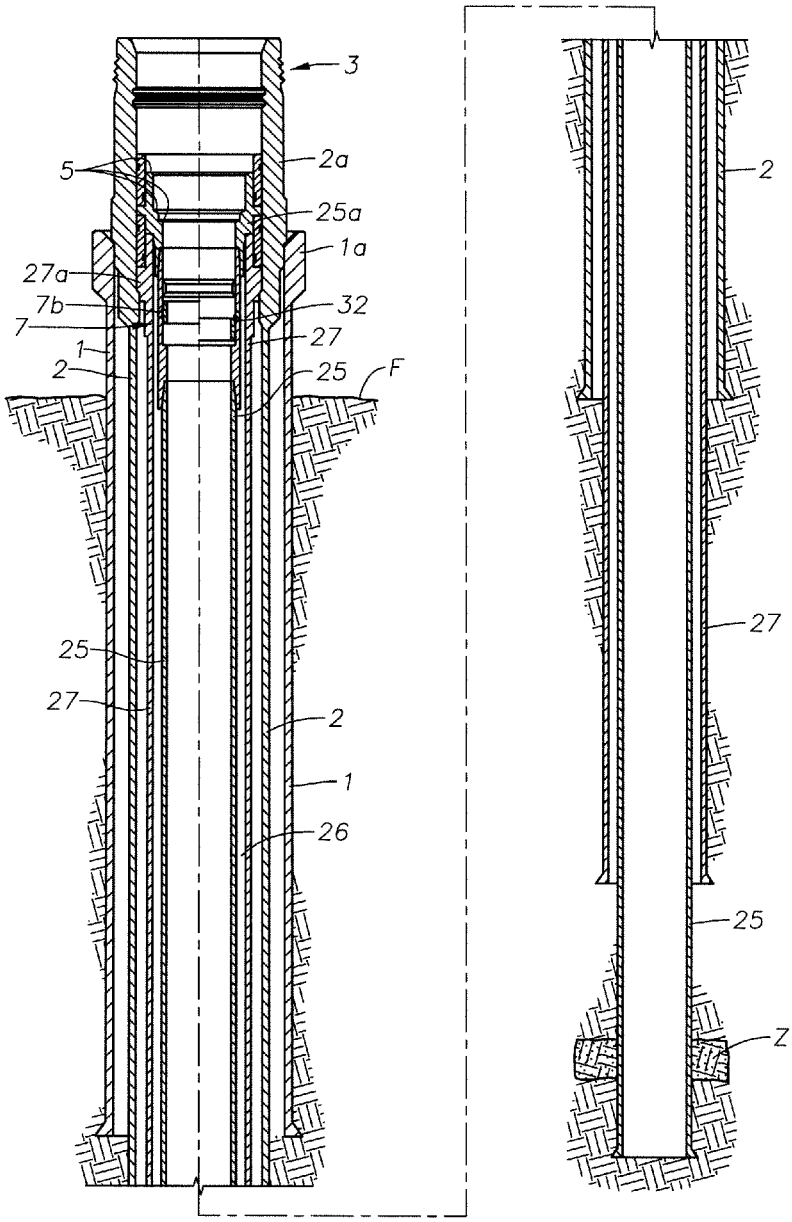
FIG. 2 is a schematic sectional elevation view showing a wellhead with casing hangers landed in the wellhead housing, and with the "B" annulus sleeve installed in the production casing string.

FIG. 2 illustrates a preferred embodiment of the present invention used in a typical well as shown in FIG. 1. It is to be understood that the wells depicted in FIGS. 1 and 2 are merely representative of a typical well for purposes of illustrating the present invention, and thus the present invention is not limited to wells of this precise configuration. Additionally, it is to be understood that the figures are not drawn to scale due to the tremendous depths to which wells are drilled. In the below description, reference is made to an "A" annulus 24 and a "B" annulus 26. The "A" annulus 24 is the annulus inside the production casing string 25 and outside the production tubing. The "B" annulus is the annulus outside the production casing string 25 and inside the intermediate casing string 27.

In the preferred embodiment shown in FIG. 2, the well system includes a modified production casing assembly allowing access to the "B" annulus 26. The modified production casing assembly includes a "B" annulus adapter assembly 7 added to the production casing string 25 and production casing hanger 25*a*. The "B" annulus access assembly 7 includes an adapter having one or more ports 32 and a "B" annulus sleeve 7*b* (better shown in FIG. 6) for reasons which will be explained below.

Figure 3A:
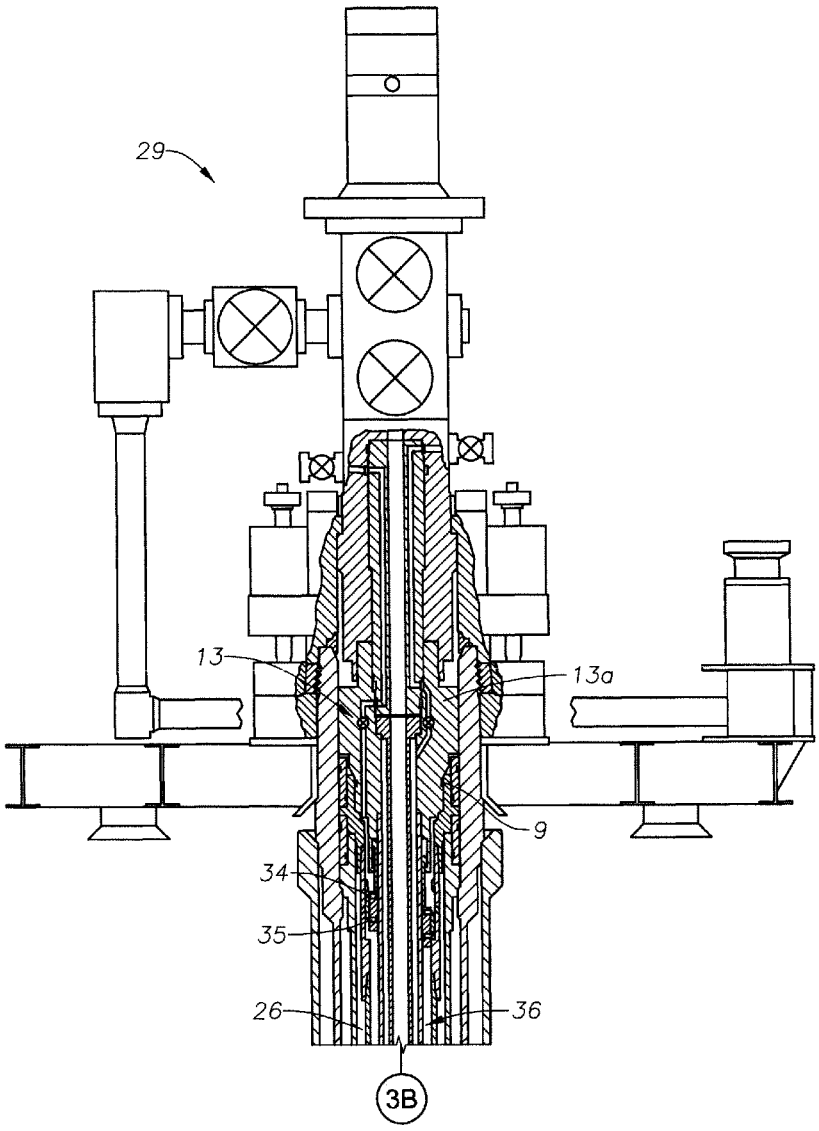
FIG. 3 (including FIGS. 3A and 3B) is a schematic sectional elevation view showing a tubing hanger suspension assembly according to a preferred embodiment of the present invention.
Figure 3B:
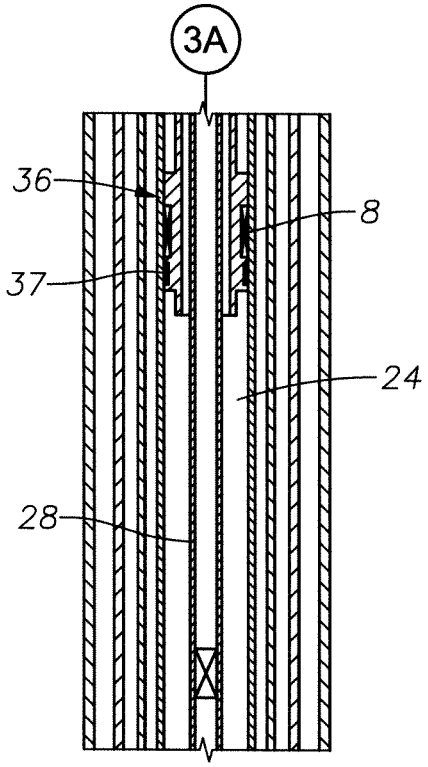
Figure 4A:
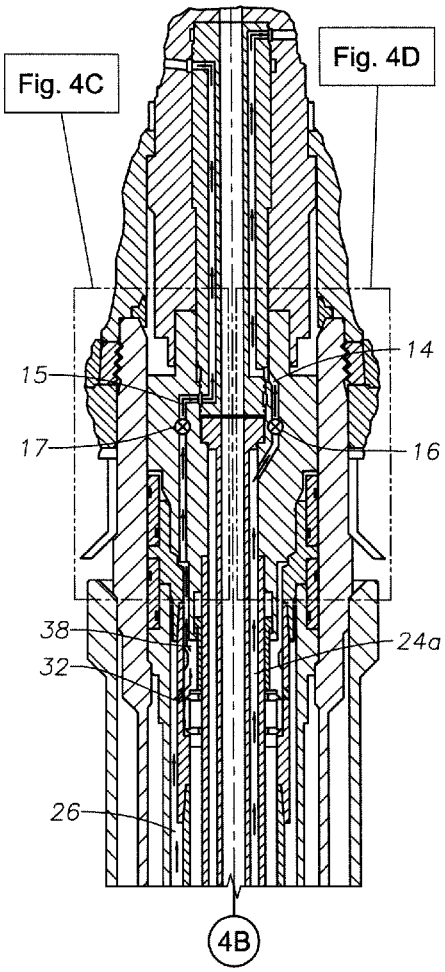
FIG. 4 (including FIGS. 4A and 4B) shows enlarged views of a portion of FIG. 3 with the "B" annulus sleeve in the open position.
FIG. 4C is an enlarged schematic sectional elevation view of the area identified in FIG. 4A as "4C"
FIG. 4D is an enlarged schematic sectional elevation view of the area identified in FIG. 4A as "4D"
FIG. 4E is an enlarged schematic sectional elevation view of the area identified in FIG. 4B as "4E"
Figure 4B:
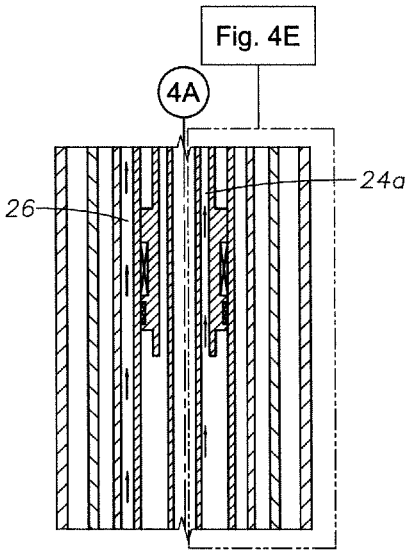
Figure 4E:
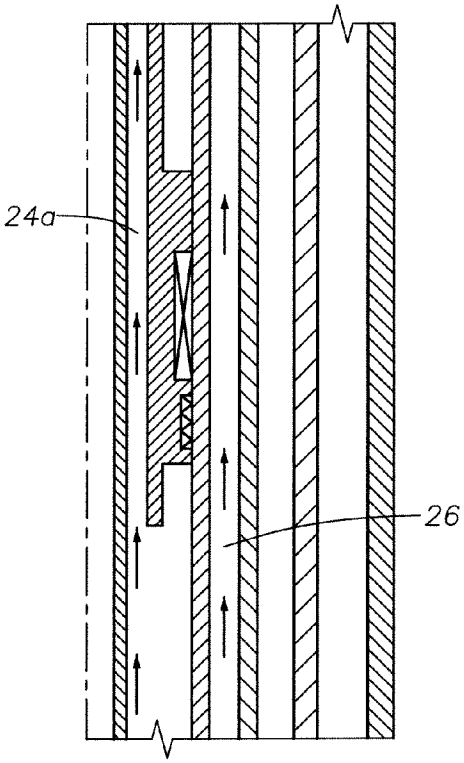
Figure 4D:
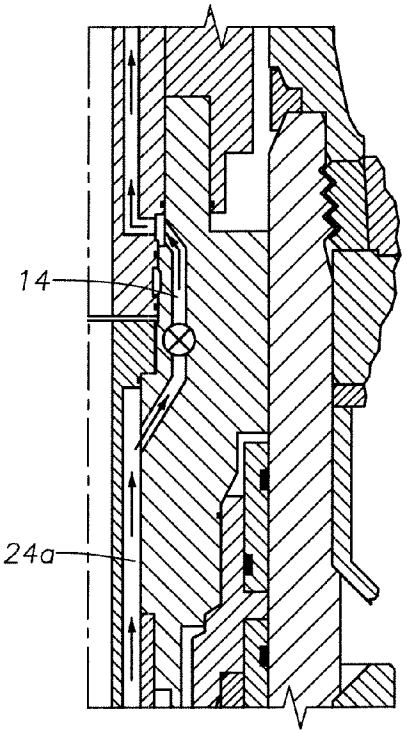
Figure 4C:
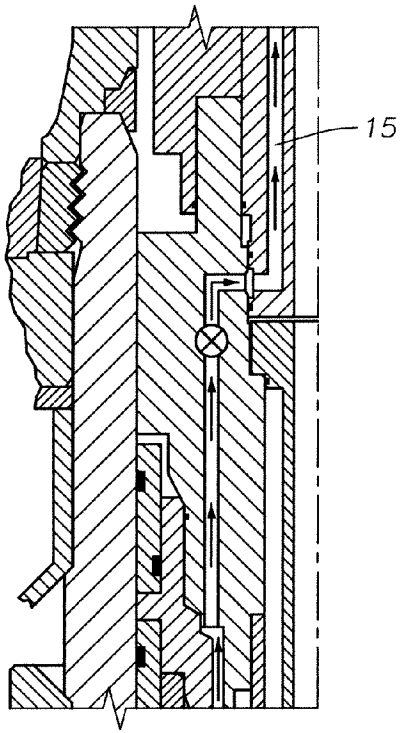
Figure 5:
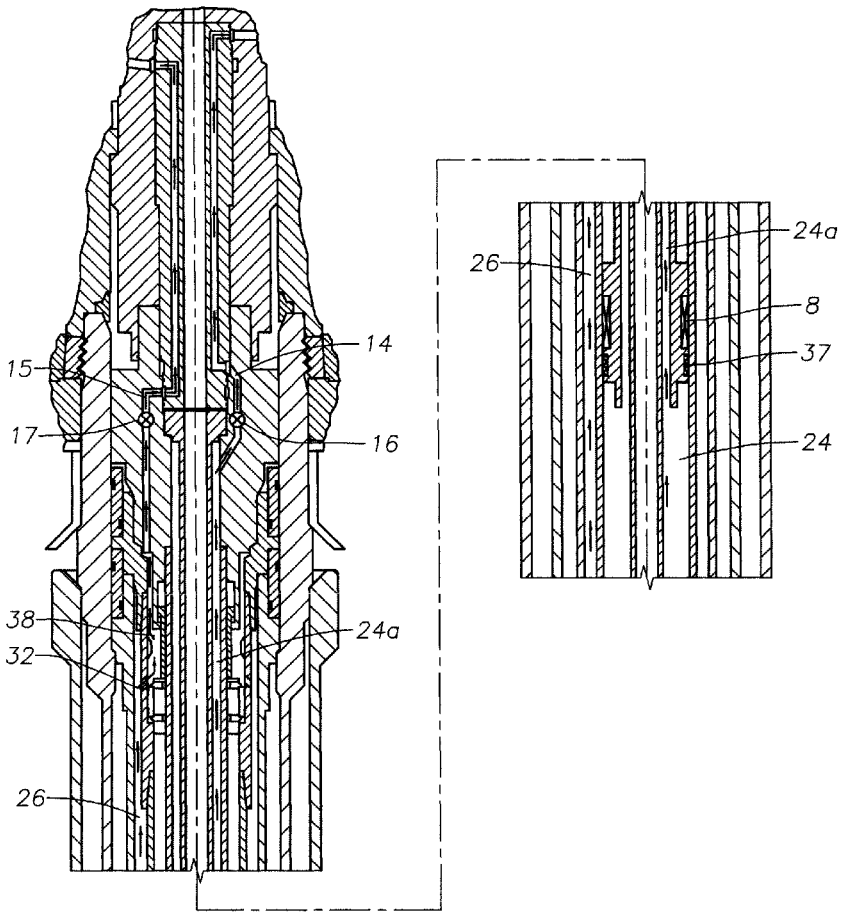
FIG. 5 is a schematic sectional elevation view showing a tubing hanger suspension assembly according to an embodiment of the present invention, and specifically identifying with arrows the "A" annulus and the "B" annulus.
Figure 6:
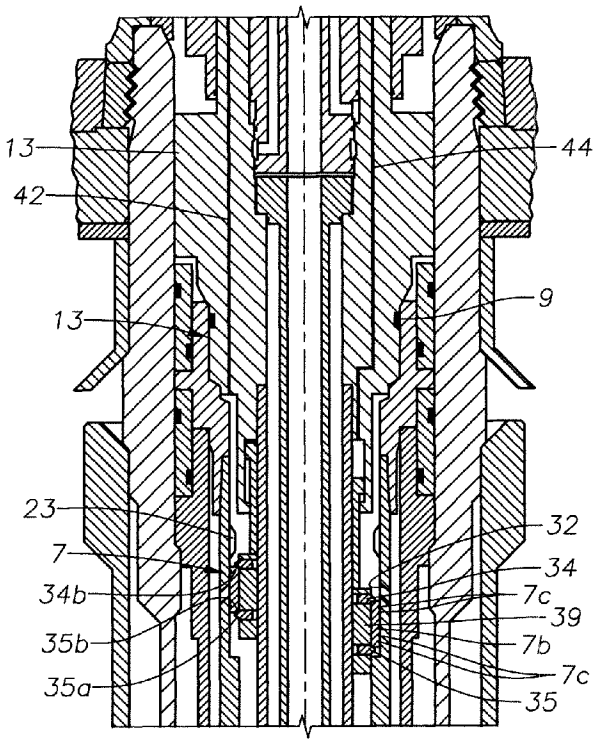

A universal tubing hanger suspension assembly 13 according to a preferred embodiment of the present invention is shown in FIGS. 3, 4 and 5. One purpose of the universal tubing hanger suspension assembly 13 is to separate the "A" annulus 24 from the "B" annulus 26. The tubing hanger suspension assembly 13 surrounds a string of production tubing 28, and includes to a tubing hanger housing 13*a*, which tubing hanger housing 13*a* is preferably arranged and designed to seal against the production casing hanger 25*a*. Preferably, the universal tubing hanger suspension assembly 13 carries an upper seal 9 for upper isolation of the "B" annulus 26 from the "A" annulus 24, and a lower seal 8 for lower isolation of the "B" annulus 26 from the "A" annulus 24, as well as sleeve lock open dogs 34 and sleeve lock closed dogs 35, which are discussed further below. FIG. 6 shows a close-up view of many of these components, including upper seal 9, and sleeve lock dogs 34, 35.

Referring to FIG. 3, the universal tubing hanger assembly 13 preferably includes a tubing hanger lower assembly 36 positioned at a lower end of the tubing hanger housing 13*a*. The tubing hanger lower assembly 36 may be connected to or integral with the tubing hanger housing 13*a*. The tubing hanger lower assembly 36 may also include a lower seal 8 and a lockdown assembly 37, and preferably includes a tubular member having a through bore, which may be a pipe or a mandrel having a bore therethrough. In addition, the tubing hanger lower assembly 36 extends around the production tubing string 28 with a production annulus 24*a* (shown in FIG. 4) defined therebetween. This production annulus 24*a* is in fluid communication with the "A" annulus 24. The purpose of the lower seal 8 is to prohibit fluid from passing between the tubing hanger lower assembly 36 and the production casing string 25. Accordingly, the only fluid communication between the "A" annulus 24 and locations above the lower seal 8, is via the production annulus 24*a*.

While the production tubing string 28 preferably has a length such that its lower end extends approximately to the production zone Z, the tubing hanger lower assembly 36 preferably has a length substantially less than the length of the tubing string 28. Preferably, the length of the tubing hanger lower assembly 36 is less than 50% the length of the tubing string 28. More preferably, its length is less than 25% the length of the tubing string 28, and most preferably less than 15% the length of the tubing string 28.

Referring to FIGS. 4 and 5, there is shown the means by which the "A" annulus 24 and the "B" annulus 26 communicate with the christmas tree 29 at the top of the well. As explained above, the fluid of the "A" annulus passes toward the top of the well through the production annulus 24*a*. Because lower seal 8 prohibits passage of the fluid of the "A" annulus in the area between the tubing hanger lower assembly 36 and the production casing string 25 above lower seal 8, this annular area 38 is separated from the area of the "A" annulus 24. In addition, at least one port 32 allows fluid communication between the "B" annulus 26 and the area 38 within the production casing string 25 above the lower seal 8. Thus, at points above the port(s) 32, the fluid of the "A" annulus is located inside the tubing hanger lower assembly 36 adjacent to the production tubing 28, while the fluid of the "B" annulus is located inside the production casing string 25, but outside the tubing hanger lower assembly 36.

The tubing hanger housing 13*a* preferably includes two annulus passageways 14 and 15 extending therethrough as shown in FIGS. 4 and 5. Upon installation of the universal tubing hanger suspension assembly 13, annulus passageway 14 is in communication with the "A" annulus 24 via production annulus 24*a*, and annulus passageway 15 is in communication with the "B" annulus 26 via the area 38 between the tubing hanger lower assembly 36 and the inside of the production casing string 25. In one preferred embodiment, the universal tubing hanger suspension assembly 13 includes annulus isolation valves 16, 17 arranged and designed to seal and close off the annulus passageways 14, 15 respectively. The annulus isolation valves 16, 17 may preferably be included in the tubing hanger housing 13*a*.

Since the length of the tubing string 28 is dependent on the depth of the production zone Z, the length of the lower assembly 36 relative to the tubing string 28 varies from well to well. Preferably, the lower assembly 36 has a length in the range of 1' to 1,500', more preferably in the range of 1' to 300', and most preferably in the range of 5' to 100'.

As discussed above, the tubing hanger lower assembly 36 carries a lower seal 8 and a lockdown assembly 37. Preferably, the tubing hanger lower assembly 36 is located near the lower end of the tubing hanger housing 13*a*. The tubing hanger lower assembly 36 preferably has an outside diameter that is slightly less than the inside diameter of the production casing 25. The lower seal 8 and the lockdown assembly 37 may be contained as a unitary assembly or may be separate. Also, as discussed above, the tubing hanger suspension assembly 13 also carries an upper seal 9 which prohibits fluid from passing between the tubing hanger suspension assembly and the production casing hanger 25*a*. Upper and lower seals 9, 8 allow isolation of the "A" and "B" annuluses 24, 26 during production of the well. These isolation seals also allow monitoring of both "A" and "B" annuluses uniquely during production also with the ability to bleed pressure during production and well shut down periods. Upper and lower seals 9, 8 may be made of any suitable material, such as, for example, an elastomeric material or metal.

Figure 7:
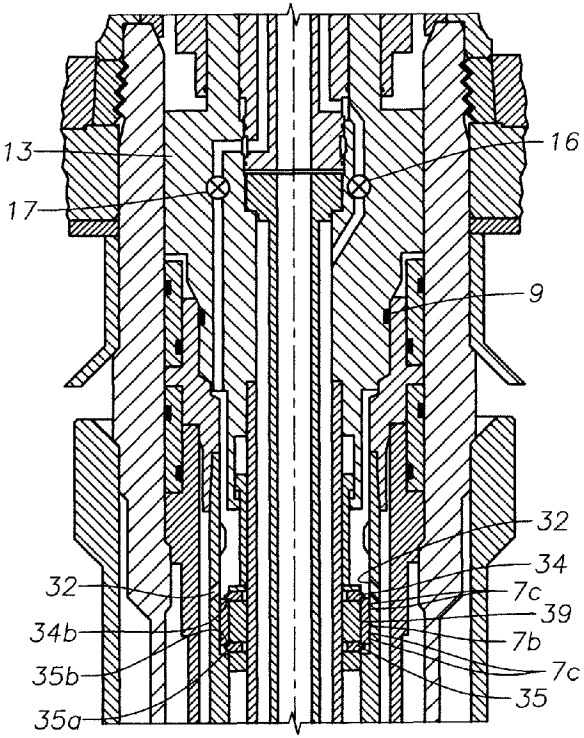
FIGS. 6 and 7 are schematic sectional elevation views taken along different planes and showing the tubing hanger assembly and the moveable sleeve according to the present invention, with FIG. 6 showing hydraulic lines that may be used to open and close the sleeve, and FIG. 7 showing annulus passageways with valves installed therein.

Referring to FIGS. 6 and 7, there is shown the operation of the annulus assembly 7, which consists of an adapter having port(s) 32, the annulus sleeve 7*b*, and a wear bushing 23. During drilling operations, and before the tubing hanger assembly 13 is inserted into the cased well bore, the port(s) 32 in the production casing annulus assembly 7 are closed with the annulus sleeve 7*b*. The annulus sleeve 7*b* is positioned over the port(s) 32 as shown on the left side of FIG. 6, and seals against the production casing 25 with annular seals 7*c*. Annular seals 7*c* are preferably o-rings and may be made of any suitable material, such as, for example, elastomeric materials, composites, or metals. As the tubing hanger assembly 13 is landed in the production casing hanger 25*a*, the tubing hanger assembly 13 is equipped with a sleeve engaging mechanism 39 carrying a pair of lock dogs 34, 35. As the tubing hanger assembly 13 travels downward, the first lock dog 35 contacts the annulus sleeve 7*b* with tapered surface 35*a*. As it passes the annulus sleeve 7*b*, the first lock dog 35 is pushed inwardly toward the production tubing 28 such that it bypasses the annulus sleeve 7*b*. Thereafter a second lock dog 34 contacts the annulus sleeve 7*b* with flat surface 34*b*. The flat surface 34*b* engages the top edge of the annulus sleeve 7*b* and pushes it downward until the tubing hanger assembly 13 is fully installed and the port(s) 32 are open.

Upon removing the tubing hanger assembly 13 from well bore, the above actions are reversed to close the port(s) 32. That is, as the tubing hanger assembly is pulled upwards, the flat surface 35*b* of the first lock dog 35 catches the lower edge of the annulus sleeve 7*b* and pulls the annulus sleeve 7*b* back into position over the port(s) 32. In this way, when the tubing hanger assembly is removed, for maintenance or any other reason, the port(s) 32 are closed. The wear bushing 23, fitted near the port(s) 32 within the annulus access adapter assembly 7 is arranged and designed to protect and help maintain the annulus sleeve over the port(s) 32 during drilling, and to prevent the annulus sleeve 7*b* from travelling above the port(s) 32 upon removal of the tubing hanger assembly 13.

In an alternative embodiment, the sleeve 7*b* can be opened and closed using hydraulics, as shown in FIG. 6. For example, hydraulic fluid may be introduced into the area above the annulus adapter assembly 7 and the sleeve engaging mechanism 39. Thereafter, by adjusting the hydraulic pressure in that area, the sleeve engaging mechanism 39 may be repositioned upwardly or downwardly. Because the lock dogs 34, 35 on the sleeve engaging mechanism 39 control the position of the annular sleeve 7*b*, as described above, the port(s) 32 can be opened or closed hydraulically while the tubing hanger assembly is installed.

As shown, for example, in FIG. 6, one or more hydraulic control lines 42, 44 may extend through the tubing hanger suspension assembly 13 to provide hydraulic control to devices in the well. For example, hydraulic control lines may activate and de-activate the lower seal 8 and locking assembly 37, the annulus sleeve 7*b*, or other devices known in the industry, such as subsurface safety valves. The hydraulic control lines may be run in the production annulus 24*a* between the tubing hanger lower assembly 36 and the production tubing string 28, or, below the lower seal 8, between the production tubing string 28 and the production casing string 25.

With regard to installation, the tubing hanger suspension assembly 13 is preferably lowered into the cased well bore and wellhead housing 2*a* with a tubing hanger running tool (not shown). The tubing hanger running tool is adapted to lock into the upper end of the tubing hanger suspension assembly 13. The tubing hanger running tool preferably includes a production bore that extends through the running tool and communicates with the bore of the tubing hanger suspension assembly 13. The tubing hanger running tool also preferably includes an annulus access bore which communicates with annulus passageways 14, 15, as well as hydraulic lines communicating with the hydraulic lines 42, 44 of the tubing hanger suspension assembly 13. It is to be understood that the tubing hanger running tool preferably includes lines for downhole hydraulics and chemical injection for communication with similar lines in the tubing hanger suspension assembly 13.

Figure 8A:
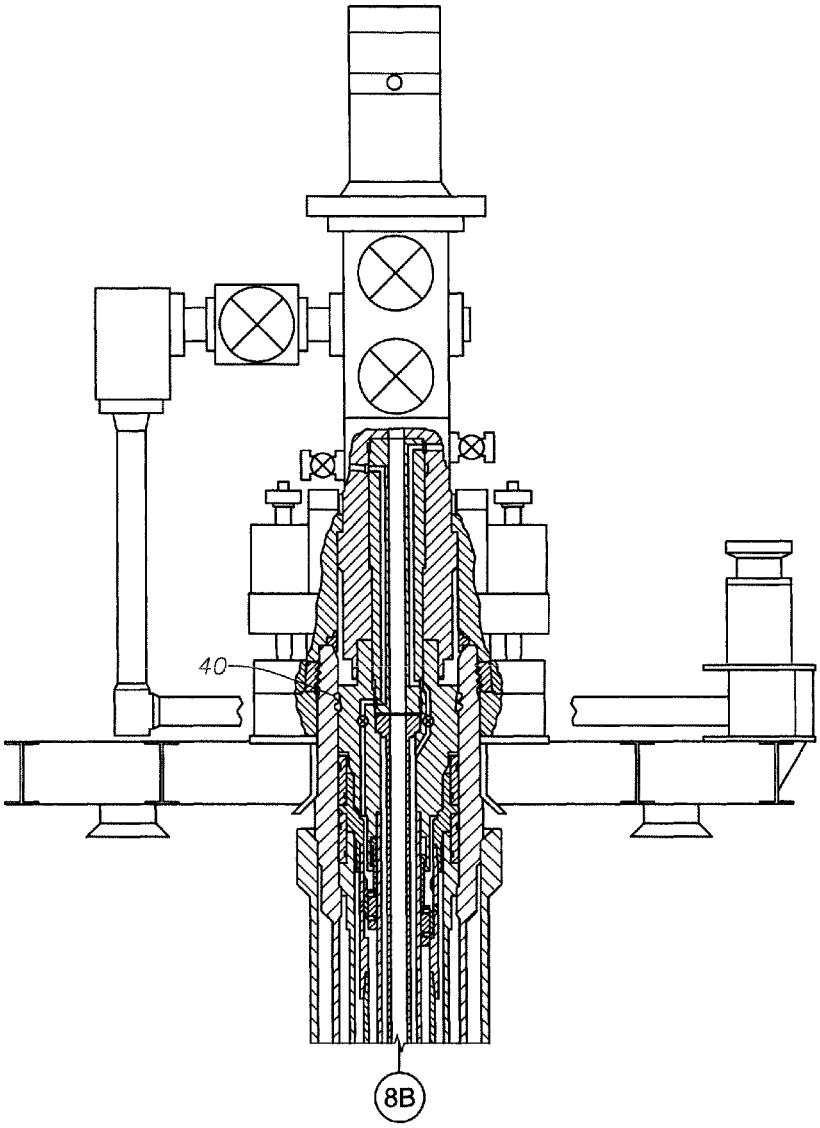
FIG. 8 (including FIGS. 8A and 8B) is a sectional elevation view of another embodiment of the present invention.
Figure 8B:
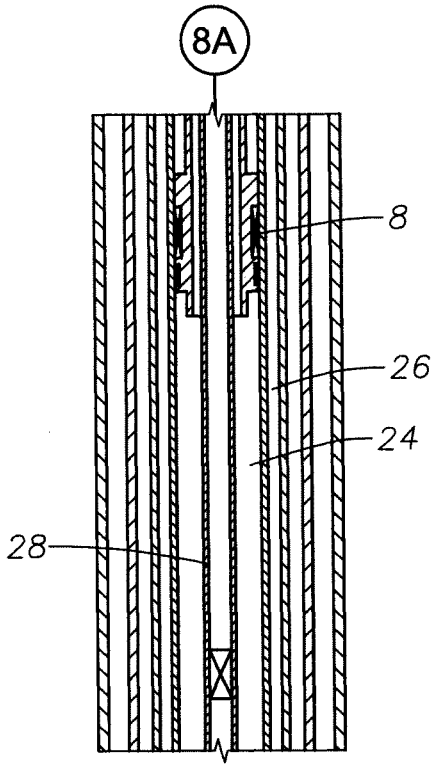

FIG. 8 represents an industry standard tubing hanger lock ring device 40. This device is standard in the industry to lock tubing hanger bodies, such as the tubing hanger suspension assembly 13, into wellhead high pressure housings 2*a*. Other aspects of the drawings depict the features of the invention discussed above. Thus, FIG. 8 illustrates how "A" and "B" annulus access can be obtained with conventional tubing hanger lock down devices.

It is to be understood that the present invention, including the universal tubing hanger suspension assembly 13, is not limited to the preferred embodiments described herein. For example, the universal tubing hanger suspension assembly 13 is not limited to the tubing hanger housing being received in the wellhead housing. Rather, the universal tubing hanger suspension assembly 13 can also be used in wells in which the tubing hanger is received in tubing spools or horizontal trees mounted on the wellhead housing. It is to be understood that, in such alternative scenarios, the lower seal 8, and optionally the lockdown assembly 37, could still be positioned in the production casing string 25 or a receptacle in that casing string.

Preferred embodiments of the tubing hanger suspension assembly, well completion system and method of installing same according to the present invention have thus been set forth. However, the invention should not be unduly limited to the foregoing, which has been set forth for illustrative purposes only. Various modifications and alterations of the invention will be apparent to those skilled in the art, without departing from the true scope of the invention.

We claim:

1. A well completion system for controlling and monitoring multiple annuluses in a well, the well having production tubing string, a production casing string surrounding the production tubing string and defining an "A" annulus therebetween, and an intermediate casing string surrounding the production casing string and defining a "B" annulus therebetween, the well completion system comprising:

a tubing hanger suspension assembly including the production tubing string and a tubing hanger housing having a tubing hanger lower assembly, the tubing hanger lower assembly extending around an upper length of the production tubing string and defining a production annulus between the tubing hanger lower assembly and the production tubing string, the tubing hanger lower assembly arranged and designed for insertion within the production casing string;

the tubing hanger lower assembly including a seal arranged and designed to provide sealed engagement between the tubing hanger lower assembly and the production casing string, the sealed engagement providing a separated area above the seal outside the lower assembly and inside the production casing string that is segregated from the production annulus, the production annulus remaining in fluid communication with the "A" annulus;

a "B" annulus access assembly including at least one port in the production casing string at a location above the seal, and providing access between the "B" annulus and the separated area, the "B" annulus access assembly including a sleeve having an open position and a closed position, the sleeve allowing fluid communication through the at least one port when in the open position, and preventing fluid communication through the at least one port when in the closed position;

the tubing hanger suspension assembly including an arrangement arranged and designed to reposition the sleeve from the closed position to the open position, thereby allowing the "B" annulus to communicate with the separated area via the at least one port;

the tubing hanger housing including "A" and "B" annulus passageways, the "A" annulus passageway in communication with the production annulus and the "B" annulus passageway in communication with the separated area.

2. The well completion system of claim 1, wherein the arrangement which repositions the sleeve from the closed position to the open position comprises a sleeve engaging mechanism attached to the tubing hanger suspension assembly, the sleeve engaging mechanism configured to contact the sleeve when the tubing hanger suspension assembly is inserted into the well, and to reposition the sleeve from the closed position to the open position.

3. The well completion system of claim 1, wherein the arrangement which repositions the sleeve from the closed position to the open position comprises a hydraulic system that repositions the sleeve from the closed position to the open position by hydraulically applying a force to the sleeve.

4. The well completion system of claim 1, wherein the arrangement arranged and designed to reposition the sleeve from the closed position to the open position is also arranged and designed to reposition the sleeve from the open position to the closed position, thereby preventing the "B" annulus from communicating with the separated area via the at least one port.

5. The well completion system of claim 4, wherein the arrangement which repositions the sleeve from the open position to the closed position and from the closed position to the open position is a hydraulic system that repositions the sleeve by applying hydraulic force.

6. The well completion system of claim 1, further comprising a christmas tree arranged and designed to communicate with the production annulus and the separated area via the annulus passageways.

7. The well completion system of claim 6, further comprising at least one valve in the "A" annulus passageway, the valve configured to isolate the production annulus from communication with the christmas tree.

8. The well completion system of claim 6, further comprising at least one valve in the "B" annulus passageway, the valve configured to isolate the separated area from communication with the christmas tree.

9. The well completion system of claim 1, further comprising a wear bushing attached to the production casing string to protect the sleeve from damage or removal when the tubing hanger suspension assembly is not in the well.

10. A method of monitoring and controlling fluid in multiple annuluses of a well, the annuluses including an "A" annulus between a production tubing and a production casing string of the well, and a "B" annulus between an intermediate casing string and the production casing string of the well, the method comprising the steps of:

providing a tubing hanger suspension assembly within the "A" annulus, the tubing hanger suspension assembly configured to seal the "A" annulus with a seal so that fluid in the "A" annulus is restricted from entering a separated portion inside the production casing string, and is channeled to a production annulus between the tubing hanger suspension assembly and the production tubing;

providing ports in the production casing string above the seal of the tubing hanger suspension assembly, thereby allowing fluid from the "B" annulus to pass through the production casing string into the separated portion inside the production casing string; and communicating with the separated portion and the production annulus to separately monitor and control the fluid within each of the annuluses.

11. The method of claim 10, further comprising the step of:

providing a moveable sleeve within the production casing string above the seal, the moveable sleeve having an open position and a closed position, the moveable sleeve allowing fluid communication through the ports when in the open position, and preventing fluid communication through the ports when in the closed position.

12. The method of claim 11, further comprising the step of:

moving the moveable sleeve from the closed position to the open position.

13. The method of claim 12, wherein the step of moving the moveable sleeve comprises a sleeve engaging mechanism attached to the tubing hanger suspension assembly contacting the moveable sleeve and moving the sleeve from the closed position to the open position as the tubing hanger suspension assembly is inserted into the well.

14. The method of claim 12, wherein the step of moving the moveable sleeve comprises applying a hydraulic force to the sleeve.

15. The method of claim 11, further comprising the step of: moving the moveable sleeve from the open position to the closed position.

16. The method of claim 15, wherein the step of moving the moveable sleeve from the open position to the closed position comprises a sleeve engaging mechanism attached to the tubing hanger suspension assembly contacting and pushing the sleeve from the open position to the closed position when the tubing hanger suspension assembly is removed from the well.

17. The method of claim 15, wherein the step of moving the moveable sleeve from the open position to the closed position comprises applying a hydraulic force to the sleeve.

18. A well completion system for separately controlling and monitoring annuluses in a well, the well having a production tubing string, a production casing string surrounding the production tubing string and defining an "A" annulus therebetween, and an intermediate casing string surrounding the production casing string and defining a "B" annulus therebetween, the well completion system comprising:

a tubing hanger suspension assembly including a tubing hanger lower assembly inserted within the production casing string, the tubing hanger lower assembly extending around an upper length of the production tubing string and defining a production annulus between the tubing hanger lower assembly and the production tubing string, the production annulus in fluid communication with the "A" annulus;

the tubing hanger lower assembly including a seal arranged and designed to provide sealed engagement between the tubing hanger lower assembly and the production casing string, the sealed engagement providing a separated area above the seal outside the lower assembly and inside the production casing string that is segregated from the "A" annulus and the production annulus;

a "B" annulus access assembly comprising at least one port in the production casing string at a location above the seal and a sleeve having an open position and a closed position, the sleeve allowing the "B" annulus fluid communication with the separated area when in the open position, and preventing fluid communication of the "B" annulus with the separated area when in the closed position; and the tubing hanger suspension assembly including an arrangement arranged and designed to reposition the sleeve from the closed position to the open position.

19. The well completion system of claim 18, wherein the tubing hanger suspension assembly includes a tubing hanger housing including "A" and "B" annulus passageways, the "A" annulus passageway in communication with the production annulus and the "B" annulus passageway in communication with the separated area.

20. The well completion system of claim 18, wherein the arrangement arranged and designed to reposition the sleeve from the closed position to the open position also repositions the sleeve from the open position to the closed position.

21. The well completion system of claim 20, wherein the arrangement comprises a hydraulic system that moves the sleeve from one position to the other position by applying a hydraulic force to the sleeve.

22. The well completion system of claim 19, further comprising a christmas tree arranged and designed to communicate with the production annulus via the "A" annulus passageway and communicate with the separated area via the "B" annulus passageway.

23. The well completion system of claim 19, further comprising a christmas tree arranged and designed to communicate with the "A" annulus via the production annulus and the "A" annulus passageway and communicate with the "B" annulus via the separated area and the "B" annulus passageway.

24. The well completion system of claim 20, wherein the arrangement comprises a sleeve engaging mechanism arranged and designed to contact the sleeve when the tubing hanger suspension assembly is inserted into the well.

25. The well completion system of claim 24, wherein the sleeve engaging mechanism repositions the sleeve from the closed position to the open position as the tubing hanger suspension assembly is inserted into the well.

26. The well completion system of claim 24, wherein the sleeve engaging mechanism repositions the sleeve from the open position to the closed position as the tubing hanger suspension assembly is removed from the well.

27. The well completion system of claim 24, wherein the arrangement further comprises a hydraulic system arranged and designed to reposition the sleeve engaging mechanism upwardly or downwardly and thus reposition the sleeve between open and closed positions while the tubing hanger suspension assembly is installed in the well.

28. A well completion system for separately controlling and monitoring annuluses in a well, the well having a production tubing string, a production casing string surrounding the production tubing string and defining an "A" annulus therebetween, and an intermediate casing string surrounding the production casing string and defining a "B" annulus therebetween, the well completion system comprising:

a tubing hanger suspension assembly including a tubing hanger lower assembly inserted within the production casing string, the tubing hanger lower assembly extending around an upper length of the production tubing string and defining a production annulus between the tubing hanger lower assembly and the production tubing string, the production annulus in fluid communication with the "A" annulus;

the tubing hanger lower assembly including a seal arranged and designed to provide sealed engagement between the tubing hanger lower assembly and the production casing string, the sealed engagement providing a separated area above the seal outside the lower assembly and inside the production casing string that is segregated from the "A" annulus and the production annulus;

a "B" annulus access assembly comprising at least one port in the production casing string at a location above the seal and a sleeve having an open position and a closed position, the sleeve allowing the "B" annulus fluid communication with the separated area when in the open position, and preventing fluid communication of the "B" annulus with the separated area when in the closed position; and the tubing hanger suspension assembly including a sleeve engaging mechanism arranged and designed to engage the sleeve when the tubing hanger suspension assembly is inserted into the well, wherein the sleeve engaging mechanism is utilized in repositioning the sleeve between the open and closed positions of the sleeve.

* * * * *